United States Patent [19]

Smith

[11] 3,970,834

[45] July 20, 1976

[54] ARTIFICIAL TREE

[76] Inventor: Marion Joseph Smith, Rte. 1, Box 117, Bowman, S.C. 29018

[22] Filed: Dec. 16, 1974

[21] Appl. No.: 532,944

[52] U.S. Cl. ..... 240/10 Q; 248/435; 428/20

[51] Int. Cl.[2] ..... F21P 1/02; F21V 21/00

[58] Field of Search ..... 240/10 Q, 10 T; 428/18, 428/19, 20; 248/435

[56] References Cited

UNITED STATES PATENTS

| | | | |
|---|---|---|---|
| 2,708,324 | 5/1955 | Wedden | 240/10 Q X |
| 3,118,617 | 1/1964 | Hellrich | 240/10 Q |
| 3,144,375 | 8/1964 | Day | 428/19 X |
| 3,603,780 | 9/1971 | Lu | 240/10 Q |
| 3,806,399 | 4/1974 | Cocjin | 240/10 Q X |

*Primary Examiner*—Joseph F. Peters, Jr.
*Attorney, Agent, or Firm*—Larry Harold Kline

[57] ABSTRACT

An artificial tree is disclosed which comprises a plurality of tree sections secured together.

16 Claims, 4 Drawing Figures

ARTIFICIAL TREE

This invention relates to artificial trees and, more particularly, to an artificial tree made up of easily storeable sections.

For many home and commercial purposes, particularly in the Christmas season, it has been a desire and custom to have a decorated tree on the premises. A real tree has the disadvantage of lasting in an attractive state for only a short period of time, not being re-usable, and therefore, being wasted at the end of the short period of time.

Even artificial trees must be decorated, and have electrical wiring and bulbs which must be draped over the tree of lights are desired. Present artificial trees do not separate into sections which are previously wired, and are not as easily stored as the present invention. The present invention contains features which improve on the concept of an artificial tree.

An object of this invention is to provide a synthetic tree which is easily stored.

A further object of this invention is to provide a synthetic tree which is made in sections.

Another object of this invention is to provide a synthetic tree which is re-usable.

Another object of this invention is to provide a synthetic tree of sections which may be folded and stored in an area much smaller than the unfolded sections.

Still another object of this invention is to provide a synthetic tree with a built-in electrical system for bulbs on the limbs.

A further object of this invention is to provide a synthetic tree with each limb separately wired so that any electrical problem on a limb will not disturb other limbs.

Still another object of this invention is to provide a synthetic tree with sections that are physically held together by connecting pieces that also provide an electrical connection.

Another object of this invention is to provide a synthetic tree with a plurality of snap rings to hold a plurality of sets of branches in place.

A further object of this invention is to provide a synthetic tree with sections including a plurality of slip collars, each capable of folding a set of branches.

These and other objects and features of this invention will be apparent from the following description and appended claims.

Briefly, the artificial tree comprises a plurality of tree sections which may be secured together. The tree may further comprise a base on which the tree sections secured together may be placed. The tree section may be hollow. There may be electrical wiring in the hollow tree sections. The tree sections may contain a center shaft and plurality of sets of branches emanating from the center shaft. Each set of branches may be supported by a slip ring secured to the center shaft. The branches may be foldable for storage purposes about the center shaft. The tree sections may further comprise a plurality of slip collars and a plurality of connecting bars securing the slip collars rigidly with each other. When the plurality of connecting bars is raised, each of the plurality of slip collars secured thereto is also raised, thereby pressing each of the plurality of slip collars against one of the plurality of sets of branches causing the one of the plurality of sets of branches to fold inward toward the center shaft, thereby making each of the plurality of tree sections more easily storable. The tree further comprises a plurality of connecting holes in each of the plurality of connecting bars, through which the connecting bars from one tree section may be rigidly secured to connecting bars from another tree section. A lever may be secured to the bottom one of the plurality of tree sections to be used below all other tree sections. The lever is rigidly secured to the plurality of connecting bars on the bottom one of the plurality of tree sections. The lever is rigidly secured to other of the plurality of tree sections by use of plurality of connecting holes in each of the plurality of connecting bars, whereby when the lever is raised, each of the plurality of connecting bars is raised. Each of the plurality of slip collars secured thereto is thereby also raised. Pressing each of the plurality of slip collars against one of the plurality of sets of branches causes the one of the plurality of sets of branches to fold inward towards the center shaft, thereby making the tree sections more easily storeable. Each of the sets of branches may contain electrical wiring for a plurality of electrical lights on each branch. The center shaft may contain electrical wiring to enable electrical connection to each branch of the sets of branches. The center shaft and each set of the sets of branches may be hollow enabling electrical wiring to pass therein. The plurality of tree sections may be secured together by a plurality of connecting pieces which provide electrical and physical connection. Each branch of the sets of branches may be electrically wired in parallel, whereby any electrical open circuit on one branch will not disturb the plurality of electrical lights on other branches. Each of the plurality of slip rings may comprise a circular wire which passes through each branch of the set of branches supported by the slip ring, and a plurality of slots, one for each branch in the set of branches supported by the slip ring, providing room for the set of branches to be folded inward toward the center shaft. An ornament physically and electrically secured to the highest of the plurality of tree sections which are secured together may be added to the top tree section. A base may be physically and electrically connected to the plurality of tree sections which are secured together. An electrical connection may lead from the base and be connected to electrical power source. Each of the plurality of sets of branches may rest on one of the plurality of slip collars.

The invention will be more fully understood from the following detailed description and appended claims when taken with the drawings in which:

Figure 1:
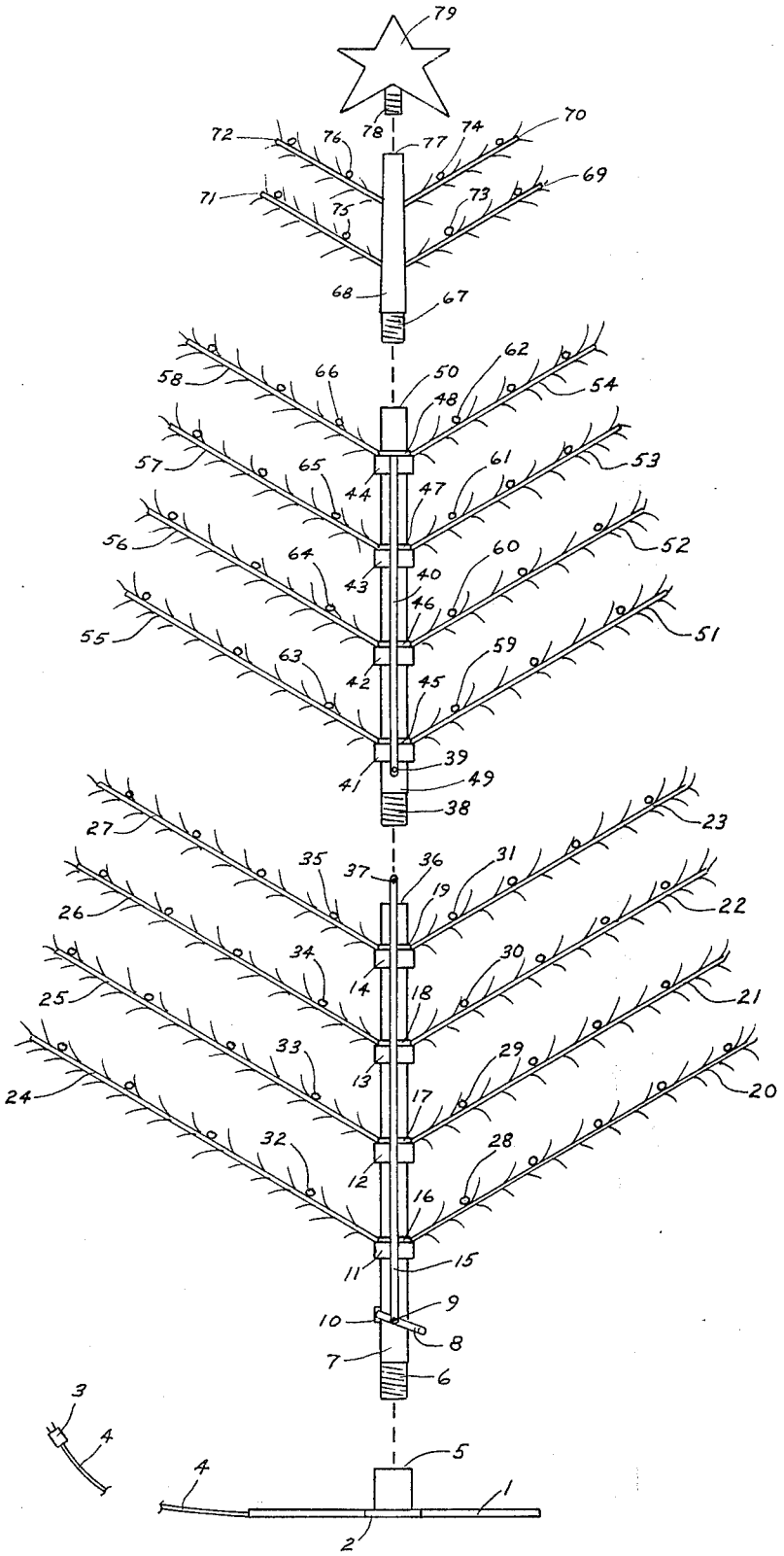
FIG. 1 is an exploded plain view of a sectional, artificial tree.

Referring now to the drawings, FIG. 1 shows an exploded plain view of a sectional, artificial tree. The tree is supported on a base which is comprised of cross support 1 and cross support 2. The electric wire 4 runs to the base and is connected to electrical plug 3, which may be connected to an external power source. The base further comprises a female electrical socket 5 which serves as a physical and electrical connection to any tree section with a male connector which might be screwed therein. A tree section with center shaft 7 may be screwed into socket 5 by the use of male connector 6 which would serve as a physical and electrical connection. The tree section with center shaft 7 would then be the bottom section of the artificial tree.

On the bottom section with center shaft 7 is shown branches 20, 21, 22, 23, 24, 25, 26, and 27. Light 28 and other lights are shown on branch 20. Light 29 and other lights are shown on branch 21. Light 30 and other lights are shown on branch 22. Light 31 and other lights are shown on branch 23. Light 32 and other lights are shown on branch 24. Light 33 and other lights are shown on branch 25. Light 34 and other lights are shown on branch 26. Light 35 and other lights are shown on branch 27.

Branch 20 and 24 are part of a set of branches (others not shown) which are supported by slip ring 16. Branch 25 and 21 are part of a set of branches (others not shown) which are supported by slip ring 17. Branch 26 and 22 are part of a set of branches (others not shown) which are supported by slip ring 18. Branch 27 and 23 are part of a set of branches (others not shown) which are supported by slip ring 19.

Connecting bar 15 connects slip collar 11, slip collar 12, slip collar 13 and slip collar 14 to lever 8. Connecting bar 15 is connected to lever 8 at pin 9. Lever 8 is supported rigidly to center shaft 7 by pivot piece 10. Lever 8 goes around center shaft 7 and may be connected to other connecting bars (not shown) similar to connecting bar 15 which may further secure slip collars 11, 12, 13 and 14 rigidly together.

When lever 8 is in its natural position, at rest, the sets of branches may rest on the slip collars 11, 12, 13 and 14, but are not otherwise affected by them. When lever 8 is raised, the slip collars 11, 12, 13, and 14, which are rigidly connected to lever 8 by connecting bar 15 and other connecting bars (not shown), press up against the plurality of sets of branches, causing each of the plurality of sets of branches to fold inward toward center shaft 7, thereby making the tree sections more easily storeable.

When lever 8 is raised, slip collar 11 presses against the set of branches which includes branch 24 and branch 20, pressing them in toward center shaft 7 and in essence, folding them in toward center shaft 7. Slip collar 12 presses in the set of branches including branch 25 and 21. Slip collar 13 presses in the set of branches including branch 26 and 22. Slip collar 14 presses in the set of branches including branch 27 and 23.

Connecting bar 15 has a connecting hole 37 at its end with a pin in the connecting hole, in order to connect the tree section, with center shaft 7, to the tree section, with center shaft 49. The tree section with center shaft 49 is screwed into the tree section with center shaft 7 by male connector 38 screwing into the female electrical socket 36. After male socket 38 is screwed into female socket 36, providing a physical and electrical connection, connecting hole 37 is connected to connecting hole 39 in connecting bar 40, providing a rigid connection. When lever 8 is raised, this rigid connection will cause connecting bar 40 also to be raised. Connecting bar 40 is one of a plurality of connecting bars which may be used around the tree, each of which would have proper connecting holes and would be properly, rigidly secured to other connecting bars on adjacent tree sections.

Emanating from center shaft 49 is shown branches 51, 52, 53, 54, 55, 56, 57 and 58. Light 59 and other lights are shown on branch 51. Light 60 and other lights are shown on branch 52. Light 61 and other lights are shown on branch 53. Light 62 and other lights are shown on branch 54. Light 63 and other lights are shown on branch 55. Light 64 and other lights are shown on branch 56. Light 65 and other lights are shown on branch 57. Light 66 and other lights are shown on branch 58.

Slip ring 45 supports a set of branches, including branch 55 and branch 51 to center shaft 49. Slip ring 36 secures a set of branches, including branch 56 and branch 52 to center shaft 49. Slip ring 47 secures a set of branches, including branch 57 and 53 to center shaft 49. Slip ring 48 secures a set of branches, including branch 58 and 54 to center shaft 49.

When lever 8 is raised, causing connecting bar 40 to be raised, slip collars 41, 42, 43 and 44, which are rigidly connected to connecting bar 40 and a plurality of other connecting bars (not shown), will also be raised. Slip collar 41 will press against the set of branches including branch 55 and 51, causing them to fold inward toward center shaft 49. Slip collar 42 will press against the set of branches including branch 56 and 52, causing them to fold inward toward center shaft 49. Slip collar 43 will press against the set of branches including branch 57 and 53, causing them to fold inward toward center shaft 49. Slip collar 44 will press against the set of branches including branch 58 and 54, causing them to fold inward toward center shaft 49.

The tree section with center shaft 49 is designed to be an upper tree section. Other tree sections may be designed between the lower tree section and upper tree section to make the tree as tall as desired, while still limiting the length of each tree section. This enables each tree section to be folded up into a small area, and the entire artificial tree, made up of sections, may be stored in a small area. The tree section with center shaft 49 could easily have an upper extension on connecting bar 40 which would connect it to other tree sections.

Another tree section is shown without folding branches, i.e. the tree section with center shaft 68. The tree section with center shaft 49 has a female electrical socket 50 onto which the male connector 67 may be screwed to provide both physical and electrical connection. The tree section with center shaft 68 shows nonfoldable limbs 69, 70, 71 and 72. Each of theses limbs is only one of a set of limbs which would go completely around the tree. Light 73 is shown on nonfoldable limb 69. Light 74 is shown on nonfoldable limb 70. Light 75 is shown on nonfoldable limb 71. Light 76 is shown on nonfoldable limb 72. Ornament 79 may be connected both physically and electrically by male connector 78 to female electrical socket 77 in center shaft 68.

Figure 2:
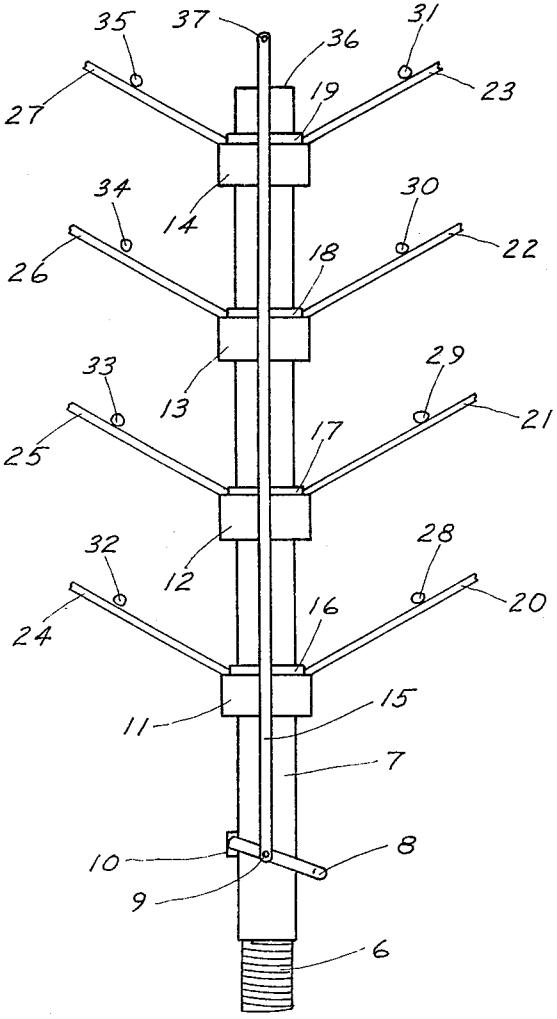
FIG. 2 is a plain view of the bottom section of a sectional, artificial tree with the limbs in an open position.

FIG. 2 shows a plain view of the bottom section of the sectional, artificial tree shown on FIG. 1. This view shows the limbs or branches opened and shows the lever 8 in a position where it is not raised, that is, in a natural position.

Figure 3:
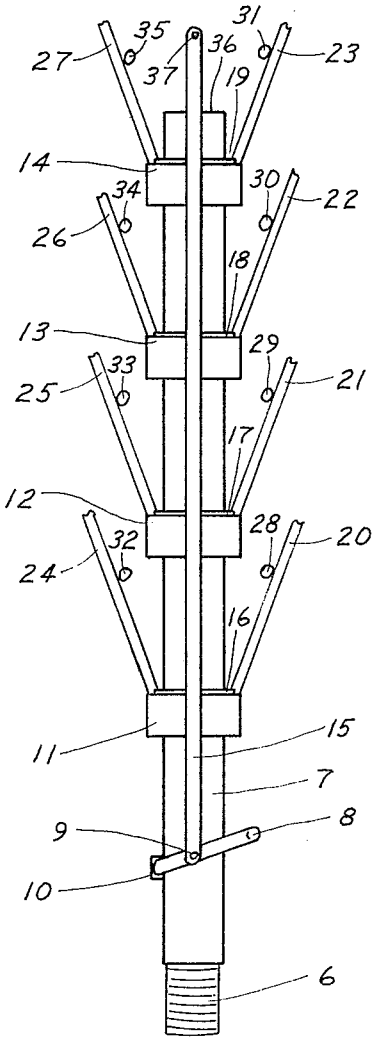
FIG. 3 is a plain view of the bottom section of a sectional, artificial tree with the limbs in a folded position.

FIG. 3 is a plain view of the bottom section of the sectional, artificial tree shown in FIG. 1, with limbs or branches in a folded position. Lever 8 has been raised, thereby raising connecting bar 15 and the slip collars 11, 12, 13 and 14, thereby pressing the branches in towards the center shaft 7 as previously discussed. The lever would not be raised unless the tree were being folded to be stored. One unique advantage of this invention is that the limbs may be folded and the tree may be stored in a much smaller area than a normal tree or artificial tree.

Figure 4:
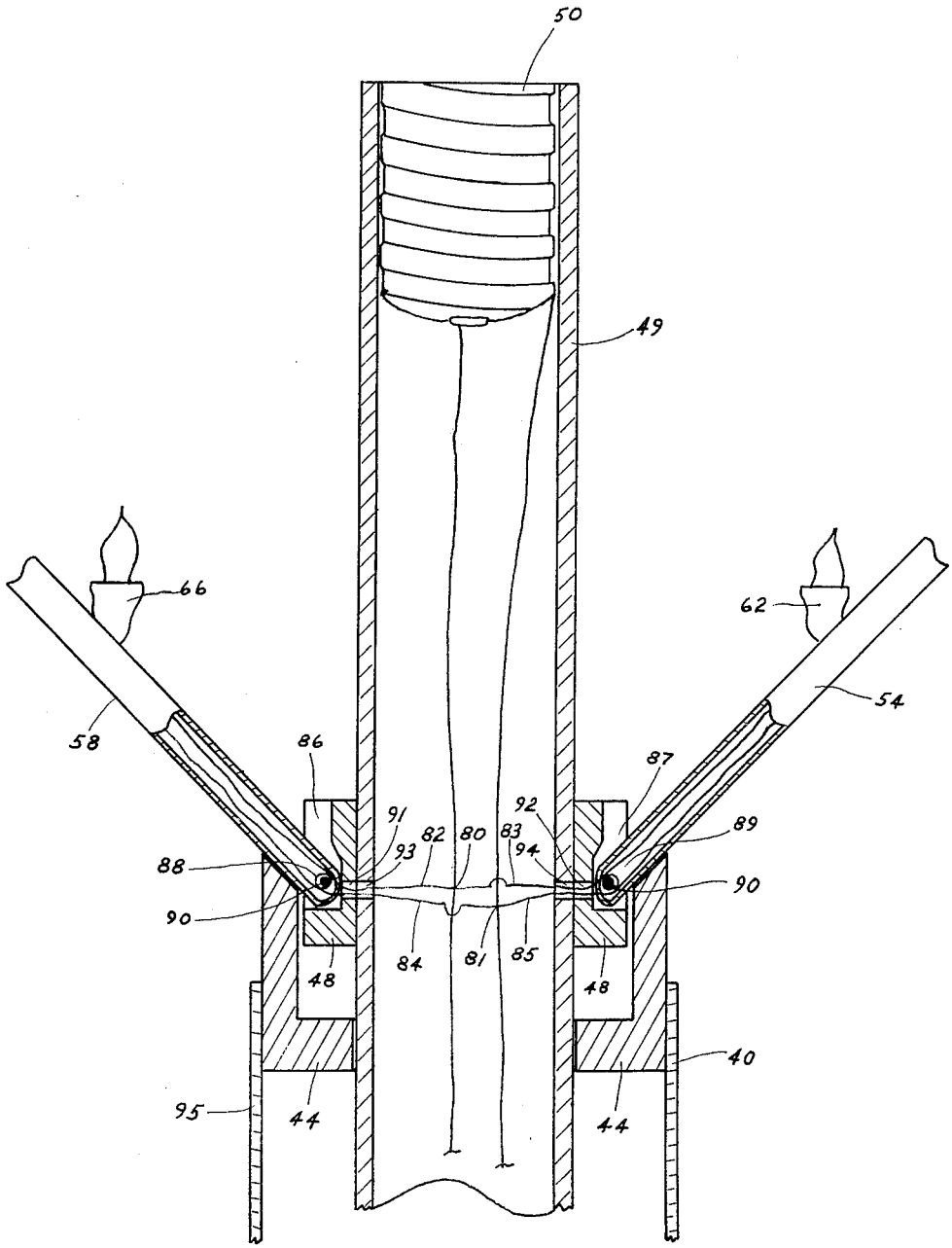
FIG. 4 is a sectional view of the top set of branches on center shaft 49, which is shown in FIG. 1.

FIG. 4 shows a sectional view of the top set of branches on center shaft 49 as shown in FIG. 1. This view shows electrical wiring within the tree section which is also a unique feature of this invention. Socket 50 is connected with electrical wires 80 and 81. Electrical wire 82 is shown connected to wire 80 and extends into branch 58. Electrical wire 84 is connected to wire 81 and extends into branch 58. Electrical wire 83 is connected to wire 80 and extends into branch 54. Electrical wire 85 is connected to wire 81 and extends into branch 54. Opening 93 in hollow shaft 49 and opening 91 in slip ring 48 provide an access for electrical wires 82 and 84 into hollow branch 58. Opening 94 in hollow center shaft 49 and opening 92 on slip ring 48 provide room for electrical wires 83 and 85 into hollow branch 54. Wires 82 and 84 provide electrical connections for light 66 and other lights on branch 58. Electrical wire 83 and 85 provide electrical connections for lights such as light 62 on branch 54. Electrical wires 83 and 85 are connected in parallel with wires 80 and 81. Electrical wires 82 and 84 are also connected in parallel with wires 80 and 81. Any open circuit on the line with wires 82 and 89 would not effect the lights on other branches since they are connected in parallel. Not shown in FIG. 4 would be the electrical connections to the other branches surrounding hollow center shaft 49 which would be connected in a similar manner as the wiring in branches 58 and 54. A plurality of branches desired may be used within a physical limit. Slip ring 48 is secured rigidly to hollow center shaft 49 by any desired process. Circular nonconducting wire 90 in slip ring 48 passes through hole 88 in branch 58 to secure the branch to the center shaft 49. Circular nonconducting wire 90 passes through hole 89 in branch 54 to secure branch 54 to center shaft 49. Slot 86 in slip ring 48 is an indented slot allowing room for the movement of branch 58 when it is pressed inward toward center shaft 49 for folding and storage purposes. Slot 87 in slip ring 48 serves to provide room for the movement of branch 54 when the branch is pressed inward toward center shaft 49 on being folded for storage purposes. Connecting bar 40 which is seen in FIG. 1 and connecting bar 95 (not shown in FIG. 1) are connecting bars which are rigidly secured to slip collar 44, which would cause slip collar 44 to be raised if the lever 8 in FIG. 1 were raised, whereby causing the set of branches, including branch 58 and 54, to be folded inward toward center shaft 49.

For purposes of clarity, the drawings, with respect to this invention, have shown only 2 branches connected to each slip ring. A set of branches, including as many branches as desired, may be placed on each slip ring. Any number of connecting bars desired, which rigidly connect the plurality of slip collars together, may be used. Any number of tree sections desired may be used. Any method of raising the slip collars so that they may press against the branches and fold them in may be used. Any method of physical and electrical connection may be used which may be desired. Any method of support of the base and outside electrical connections may be used.

Any ornaments which could be added to any ornamental tree such as a Christmas tree can be added to this artificial, sectional tree. Any other lights which may be desired, which may be physically added to any other ornamental tree, may be added to this tree. Any type of decoration which may be added to any tree may be added to this tree. Any number of lights on each branch may be designed into this tree. Any needles on artificial tree branches may also be added. An ornament can be added to the tree which is not electrically and physically connected to the rest of the tree, but is simply physically connected.

This invention fulfills the objects of the invention. It provides a synthetic tree which is easily stored. The tree is made of sections. The tree is reusable. The tree has sections which may be folded and stored in an area much smaller than the unfolded sections. The tree has a built-in electrical system for bulbs on the limbs or branches. The tree has each branch separately wired so that any electrical problems on a limb or branch will not disturb other limbs or branches. The tree has sections which are physically bound together by connecting pieces that also provide an electrical connection. The tree has a plurality of slot rings which hold a plurality of branches in place. The tree has sections including a plurality of slip collars capable of folding sets of branches.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. An artificial tree comprising a plurality of tree sections secured together to form said artificial tree, each of said plurality of tree sections comprising a center shaft, a plurality of slip rings secured to said center shaft, a plurality of sets of branches attached to and emanating from said plurality of slip rings, each of said plurality of sets of branches being supported on each said center shaft by one of said plurality of slip rings, an upper connection peice on the top of said center shaft, and a lower connection piece on the bottom of said center shaft wherein each of said plurality of tree sections further comprises:

a. a plurality of slip collars, and b. a plurality of connecting bars securing said plurality of slip collars rigidly with each other.

2. An artificial tree according to claim 1 further comprising raising means wherein when said plurality of connecting bars is raised, each of said plurality of slip collars secured thereto is also raised, thereby pressing each of said plurality of slip collars against one of said plurality of sets of branches causing said one of said plurality of sets of branches to fold inward toward said center shaft, thereby making each of said plurality of tree sections more easily storable.

3. An artificial tree according to claim 2 further comprising a plurality of connecting holes in each of said plurality of connecting bars through which connecting bars from one of said plurality of tree sections may be rigidly secured to connecting bars from another of said plurality of tree sections.

4. An artificial tree according to claim 3 further comprising a lever secured to the bottom one of said plurality of tree sections, to be used below all other tree sections, said lever being secured to the plurality of connecting bars on said bottom one of said plurality of tree sections, and said lever being secured to other of said plurality of tree sections by use of said plurality of connecting holes in each of said plurality of connecting bars, whereby when said lever is raised each of said plurality of connecting bars is raised, each of said plurality of slip collars secured thereto is also raised, thereby pressing each of said plurality of slip collars against one of said plurality of sets of branches causing said one of said plurality of sets of branches to fold inward toward said center shaft, thereby making each of said plurality of tree sections more easily storeable.

5. An artificial tree according to claim 1 wherein each of said sets of branches contains electrical wiring for a plurality of electrical lights in each branch of said sets of branches.

6. An artificial tree according to claim 5 wherein said center shaft contains electrical wiring to enable electrical connection to each branch of said sets of branches.

7. An artificial tree according to claim 6 wherein said center shaft and each branch of said sets of branches are hollow enabling electrical wiring to pass therein.

8. An artificial tree according to claim 7 wherein said plurality of tree sections are secured together by a plurality of connecting pieces which provide electrical and physical connection.

9. An artificial tree according to claim 7 wherein each branch of said sets of branches is electrically wired in parallel, whereby any electrical open circuit on one branch will not disturb said plurality of electrical lights on other branches.

10. An artificial tree according to claim 1 wherein said plurality of tree sections are secured together by a plurality of connecting pieces which provide electrical and physical connection.

11. An artificial tree according to claim 1 wherein each of said plurality of slip rings comprises:

a. a circular wire which passes through each branch of the set of branches supported by the slip ring; and b. a plurality of slots, one for each branch in the set of branches supported by the slip ring, providing room for said set of branches to be folded inward toward said center shaft.

12. An artificial tree according to claim 1 further comprising a base on which said plurality of tree sections secured together may be placed.

13. An artificial tree according to claim 12 further comprising an ornament physically and electrically secured to the highest of said plurality of tree sections secured together.

14. An artificial tree according to claim 12 wherein said base is physically and electrically connected to said plurality of tree sections secured together.

15. An artificial tree according to claim 14 further comprising an electrical connection leading from said base which may be connected to an electrical power source.

16. An artificial tree according to claim 1 wherein each of said plurality of sets of branches rests on one of said plurality of slip collars.

* * * * *